United States Patent [19]

Marten et al.

[11] Patent Number: 4,744,969

[45] Date of Patent: May 17, 1988

[54] PROCESS FOR THE CONVERSION OF COAL AND GYPSUM TO VALUABLE PRODUCTS

[75] Inventors: Jerome H. Marten; Timothy J. Kendron, both of Lakeland, Fla.

[73] Assignee: Florida Institute of Phosphate Research, Bartow, Fla.

[21] Appl. No.: 939,964

[22] Filed: Dec. 10, 1986

[51] Int. Cl.[4] ..... C01B 17/50

[52] U.S. Cl. ..... 423/541 R; 423/168; 423/171; 423/172; 423/542; 423/555; 201/12; 201/15; 201/16; 201/21; 201/25; 106/109; 48/197 R; 48/210

[58] Field of Search ..... 423/539, 171, 555, 172, 423/168, 178, 542, 638, 541 R; 48/197 R, 210; 106/109, 117; 201/12, 16, 20, 25, 31, 15, 21

[56] References Cited

U.S. PATENT DOCUMENTS

| | | | |
|---|---|---|---|
| 3,717,700 | 2/1973 | Robinson et al. | 423/542 |
| 3,729,551 | 4/1973 | Gorin | 423/638 |
| 4,102,989 | 7/1978 | Wheelock | 423/638 |
| 4,197,285 | 4/1980 | Yang et al. | 423/244 |
| 4,503,018 | 3/1985 | Gardner et al. | 423/168 |
| 4,508,544 | 4/1985 | Moss | 423/542 |

*Primary Examiner*—Helen M. S. Sneed
*Assistant Examiner*—Anthony McFarlane
*Attorney, Agent, or Firm*—Bernard, Rothwell & Brown

[57] ABSTRACT

The present invention relates to the coproduction of a combustible feed gas stream useable as an energy source and a sulfur-containing second gas stream useable as a feedstock for the production of sulfuric acid. The process includes heating coal in the presence of an oxygen-lean atmosphere under partial coal gasifying conditions to produce a solid carbonaceous char and a crude coal-gas stream. Sulfur-containing compounds are removed from the coal gas stream and converted to solid sulfur-containing materials. The solid sulfur-containing materials are combined with the solid carbonaceous char and gypsum to form a feed mixture. The non-gypsum portion of the feed mixture contains sufficient reducing potential to release substantially all of the sulfur in the gypsum as gaseous compounds of sulfur in a +4 or lower oxidation state. The feed mixture is heated under reducing conditions to produce a sulfur-containing second gas stream and a solid sintered product.

26 Claims, 4 Drawing Sheets

PROCESS FOR THE CONVERSION OF COAL AND GYPSUM TO VALUABLE PRODUCTS

BACKGROUND OF THE INVENTION

The present invention relates to the economical conversion of relatively low-value coal and gypsum to valuable gas streams and solid products. More particularly, the invention relates to a process for the coproduction of a combustible gas stream usable as an energy source and a sulfur-containing gas stream usable as a feedstock for the production of sulfuric acid. An additional useful by-product of the process is a sintered solid inorganic product that may be used as an aggregate for paving materials as well as other uses.

Natural phosphate rock, particularly the mineral, apatite (calcium phosphate), is a primary commercial source of phosphorus. One of the most common methods of producing phosphoric acid from phosphate rock is the acid or wet process. The wet process comprises digesting refined phosphate rock with sulfuric acid to produce phosphoric acid and an impure calcium sulfate, known as phosphogypsum. Phosphogypsum has, until recently, been considered a waste product of the wet process, having no commercial value. Thus great mounds of phosphogypsum have accumulated near and around phosphoric acid plants. These mounds of phosphogypsum pose an environmental problem due mainly to the acidulation of rainwater runoff from the soluble compounds in the phosphogypsum.

One commercially valuable process for the conversion of phosphogypsum into useful products is disclosed in U.S. Pat. No. 4,503,018 issued to Gardner et al. ("Gardner"), which is incorporated herein by reference in its entirety. The Gardner process yields a sulfur-containing gas stream resulting from the thermal decomposition of the gypsum. More specifically, the Gardner process involves charging a pelletized mixture of carbonaceous material and gypsum to a travelling grate where the mixture is dried and heated to produce a gaseous effluent containing sulfur dioxide and/or sulfur. After the pellets have undergone thermal decomposition, the lime residue may be sold or used in conventional applications.

The gypsum desulfurization process taught by Gardner is, overall, endothermic. The process therefore employs an external source of heat for the thermal decomposition of the gypsum. In one embodiment, the Gardner process utilizes a coal gas producer operating on a high-sulfur coal to produce a hot, raw, low-BTU gas. The coal gas producer thus supplies heated gas to the travelling grate reactor. Although Gardner contemplates recovering heat from the product gas, the process does not yield significant amounts of energy for export.

The optional coal gas producer used in the Gardner process is one which converts substantially all of the carbonaceous and sulfurous compounds in the coal to volatile gases which are fed, without pretreatment, directly to the travelling grate reactor. The carbon from the coal feedstock therefore functions largely as a source of heat and does not participate significantly in the chemical reduction of the sulfur compounds in the gypsum. A substantial portion of the sulfur from the coal feedstock emanates from the coal gas producer in the form of hydrogen sulfide. Certain disadvantages have attended feeding high-hydrogen sulfide content gases directly to the travelling grate reactor. For example, when such gases are combusted directly, they lead to higher water content and lower $SO_2$ content in the gaseous product than when solid sulfur-containing materials are fed to the reactor.

The Gardner process is a valuable process for converting phosphogypsum into usable products, and those skilled in the art are continuously striving to find methods of improving the efficiency of desulfurization of gypsum and upgrading the quality of the products of that process.

SUMMARY OF THE INVENTION

The present invention relates to the coproduction of a combustible first gas stream usable as an energy source and a sulfur-containing second gas stream usable as a feedstock for the production of sulfuric acid. The process includes heating coal in the presence of an oxygen-lean atmosphere under partial coal-gasifying conditions to produce a solid carbonaceous char and a crude gas stream. Sulfur-containing compounds are separated from the crude gas stream to produce a combustible first gas stream. The sulfur-containing compounds are converted to solid sulfur-containing materials and are combined with the solid carbonaceous char and gypsum to form a feed mixture. The non-gypsum portion of the feed mixture contains sufficient reducing potential to reduce the sulfur in the gypsum to gaseous compounds of sulfur in a +4 or lower oxidation state. The feed mixture is heated under reducing conditions to produce a sulfur-containing second gas stream. The process also yields a solid sintered product having value as, e.g., an aggregate for paving mixtures.

The process is particularly useful for efficiently converting low-value products, such as high-sulfur, low-BTU coal and phosphogypsum to valuable products, including sulfuric acid and a quality aggregate material, with a net export of energy. The process is thus highly advantageous from the environmental standpoint, in that it utilizes phosphogypsum, an environmental pollutant, and an energy standpoint, in that relatively low-quality coal can be converted to a clean combustible gas and a carbon source for the gypsum desulfurization reactor.

DETAILED DESCRIPTION OF THE INVENTION

Figure 1:
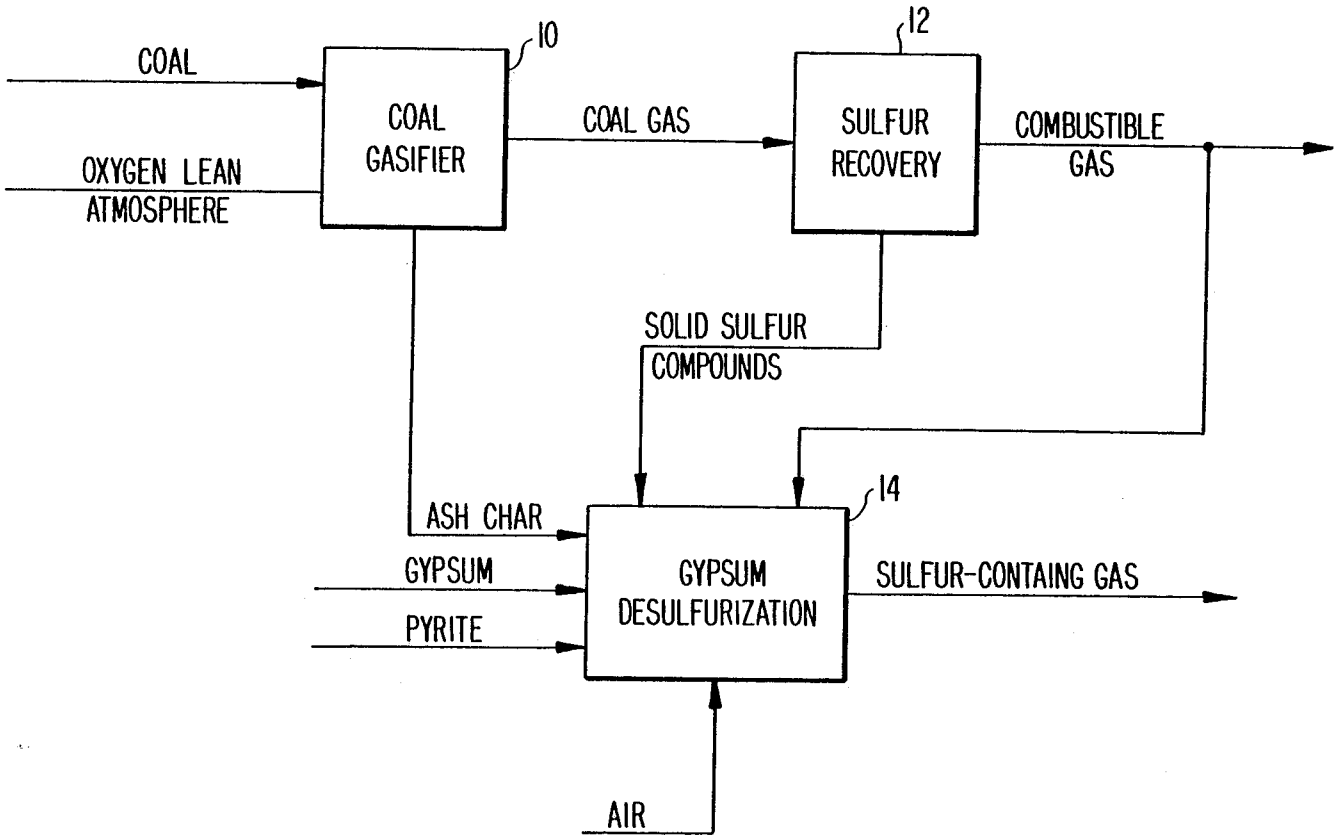
FIG. 1 is a schematic diagram of the principal features of a process of this invention for the coproduction of a combustible first gas stream and a sulfur-containing second gas stream.

The first step of the process of this invention involves the partial gasification of a coal feedstock to produce a solid carbonaceous char and a crude gas stream. Unlike conventional coal gasification operations in which substantially complete gasification of the carbonaceous component of the coal is sought, in the present process the coal is heated under partial gasifying conditions so as to leave a substantial portion of the carbon as a solid carbonaceous char. The partial gasifying conditions are achieved primarily by conducting the gasification in an oxygen lean atmosphere at a lower temperature than is employed in conventional coal gasification operations. The gasification temperature is a function of the flow rate and oxygen content of the gas fed into the gasifier, the nature of the coal (i.e., BTU content), and the residence time of the coal in the gasifier.

The partial gasifying conditions generally include an oxygen-lean atmosphere and a temperature of from about 700° C. to about 1100° C. Substantially lower temperatures may not achieve adequate gasification or volatilization of the sulfur components of the coal, whereas higher temperatures may result in excess gasification or difficulties in controlling the rate of gasification. The coal-gasifying conditions preferably include a temperature of from about 750° C. to about 1000° C.

As used herein, the term "oxygen lean atmosphere" indicates that, during the time the coal is in the gasifier, insufficient oxygen is supplied to the coal to cause complete combustion of the volatile carbon compounds. Thus, both the flow rate and oxygen content of the gas supplied to the coal gasifier may be varied to control the degree of combustion. Advantageously, the amount of oxygen supplied to the gasifier is sufficient to convert complex volatile carbon compounds to simple combustible gases, such as carbon monoxide, methane and hydrogen. Air is conveniently used as the oxygen-lean atmosphere, and the flow rate is controlled to obtain the desired gasification temperature and degree of combustion.

In one embodiment of the invention, steam is also introduced into the coal gasifier. Advantageously, waste heat is recovered from the crude gas stream in a waste heat boiler, which is used as a source of steam for the gasifier. It is well-known to use steam as a reactant in coal gasification processes. The steam provides a source of hydrogen, resulting in a gas richer in hydrogen. Moreover, steam acts as a quencher and thus provides an additional means for controlling the temperature. When steam is employed in the gasification step, the amount is controlled, in combination with the amount of oxygen, to achieve a desired gasifier exit temperature.

One advantage of this process is that the coal which is fed to the gasifier may be of varying quality, and one may readily switch from one grade of coal to another. Typical coals include lignite, subbituminous bituminous and the like. Preferably, the coal has a high sulfur content which further adds to the efficiency of the present invention due to its lower price and contribution of additional sulfur to the product sulfur-containing gas.

Conventional coal gasification equipment may be used, provided that it has means for controlling operating parameters so as to achieve partial gasifying conditions. Examples of suitable gasification equipment are fixed and fluid bed reactors. One example of a fluidized bed gasifier that is particularly preferred is the so called "Winkler gasifier," and is described in U.S. Pat. No. 4,017,272, incorporated herein by reference.

The reaction in the gasifier is advantageously conducted under superatmospheric pressures, generally above 1.5, for instance from about 1.5 to 20, advantageously from about 2 or 2.5 to 15, and preferably from about 6 to 14, atmospheres absolute. The selection of the superatmospheric pressure which may be employed in a given plant will depend on the design and pressure tolerance of the processing equipment, the pressure drop provided by the equipment downstream of the gasifier, the particular use desired for the product gas, whether multiple gasifiers are used in trains, and the like. The use of the higher reaction pressures in this invention may also enhance the throughput of the gasifier.

When a fluidized bed type gasifier is used, the fluidizing medium advantageously may be steam, which also serves as a reactant. It can also be air, carbon dioxide or recycle gas, each with or without steam. Steam is particularly attractive as a fluidizing medium, and may also be used as a diluent gas for the gasifying medium, in that it can be condensed and easily separated from the crude gas stream, leaving a higher heat value product gas.

The coal should only have a residence time within the oxygen-lean atmosphere in the gasifier for a time sufficient to produce a gaseous effluent and the desired solid carbonaceous char. The optimum residence time may vary widely and is a function of the gasifier temperature, the oxygen content and flow rate of the oxygen-lean atmosphere, the coal quality, particle size, and reactivity (e.g., the porosity, volatiles content), and the like. For a particular reaction, the optimum residence time may be readily determined empirically.

In one particularly preferred embodiment of the present process, the coal gasification step is conducted in a pressurized, fluidized bed gasifier, with steam and the oxygen-lean atmosphere introduced at spatially-separate points, substantially uniformly distributed circumferentially, at different levels in the gasifier and in amounts sufficient to substantially contact and gasify a portion of the constituents of the fluidized bed under controlled selective reaction conditions. The details of such procedure are taught in the above-mentioned U.S. Pat. No. 4,017,272, incorporated herein by reference.

The gasifier produces a crude gas stream containing various amounts of nitrogen, carbon monoxide, carbon dioxide, hydrogen, hydrogen sulfide and methane. The amount of methane produced may be influenced by the operating conditions of the gasifier.

In addition to the above gases in the crude gas stream, the stream typically contains particulate materials including char and sulfur compounds. Preferably, the crude gas stream is passed through a particulate removal zone, i.e., dry cyclone, and the particulates are recycled to the gasifier or fed to the gypsum desulfurization reactor.

After the particulates have been removed from the crude gas stream, the sulfur-containing compounds are separated from the crude gas stream and converted into solid sulfur-containing compounds. Sulfur recovery processes are well-known, and any of a variety of such processes may be employed for the sulfur-removing step of the present process. Preferred sulfur-removal processes include absorption-solution regeneration processes, wherein the regeneration procedure yields solid sulfur. Such processes include, for example, the well-known Stretford and Giammarco-Vetrocoke processes and the LO-CAT® process which is commercially available from ARI Technologies, Inc., Palatine, Ill., U.S.A. General descriptions of such sulfur-removal processes may be found in Kirk-Othmer, *Encyclopedia of Chemical Technology,* Third Ed., Vol. 22, pp. 267–297, John Wiley & Sons, New York (1983) and references cited therein. Sulfur-removal processes are also described in U.S. Pat. Nos. 3,897,219, 4,009,251, and 4,036,942, incorporated herein by reference.

The effluent from the sulfur-recovery step is a clean-burning, low-BTU combustible gas stream which may be used advantageously as an energy source for both internal requirements and export. For example, the combustible gas may be burned to produce steam which, in turn can be used to generate electrical power. The combustible gas stream may also be used as a power gas, i.e., a fuel for a gas turbine. A portion of the combustible gas stream is used to heat the gypsum mixture in the gypsum desufurization step of this invention.

Aside from the crude gas stream, a carbonaceous char is produced in the gasifier. Since there has been some oxidation of the carbon in the coal to form the crude coal gas stream, there will be some increase of the ash content in the product char on a weight basis. Upon removal from the gasifier, the char is fed to a feed preparation zone and combined with gypsum and the solid sulfur materials obtained from the sulfur recovery step.

The char and solid sulfur compounds are mixed with gypsum and used as the feed mix for the gypsum desulfurization reactor. The proportions of char, sulfur compounds, gypsum and other components are such that the non-gypsum portion of the feed mixture contains sufficient reducing potential to reduce a substantial portion, preferably substantially all, of the sulfur in the gypsum to gaseous compounds of sulfur in a +4 or lower oxidation state. While the weight percentage of the char to the overall weight of the total feed mixture may vary, the char is generally employed in amounts to provide a carbon content ranging from about 3 to about 11% by weight of the total feed mixture on a dry weight basis. Preferably, the weight percent of carbon is from about 4 to about 9 percent by weight.

Both natural and by-product gypsums, such as those which originate from the production of phosphoric acid and which are commonly known as phosphogypsum, can be used in the mixture. The particle size of the gypsum may range from about 20 mesh to 500 mesh and contain from 60 to 95% $CaSO_4$ in the form of crystals. While the amount of gypsum in the mixture can vary, the gypsum is generally present in amounts from about 50 to about 80 percent by weight of the overall mixture on a dry weight basis. Preferably, the gypsum is present in amounts ranging from about 55 to about 75 percent by weight of the feed mixture.

In a preferred embodiment and in accordance with the teachings of U.S. Ser. No. 927,439 filed Nov. 3, 1986, which is incorporated by reference, a combination of gypsum, pyrite and carbonaceous material, which in the present case can be char, may be used as the feed mix for the gypsum desulfurization reactor. In addition to pyrite, other iron and sulfur-containing minerals may be used, all of which are referred to herein collectively as "pyritic materials." Such pyritic materials include, for example, pyrite, metallic iron, elemental sulfur, iron oxide, iron (II) sulfide, and combinations thereof. As taught in the above-cited application, the combination of pyrite and carbonaceous material significantly improves the solid sintered by-product and increases the sulfur level of the gaseous effluent which is produced in the gypsum desulfurization reactor. In addition, the sulfur removal efficiency of the overall process is improved while addressing the ecological need for a clean and efficient method of disposal for pyritic materials. The amount of pyritic material added to the feed mix may vary considerably depending on the amount of char and other sulfur compounds added to the mix and the amount of ash contributed by the char. In general, the pyritic material may be present in amounts ranging from about 0 to about 20 percent by weight of the total feed mixture on a dry weight basis. Preferably, the weight percent of the pyritic material is from about 5 to about 15 percent of the feed mixture.

Optional additives may be incorporated into the feed mixture. Examples of such additives include clay (e.g., clay slime tailings resulting from the benefication of phosphate rock), recycled sintered material (also known as returns), and binding agents such as lime. The preferred additive is clay. The non-return additives may be present in amounts from 0 to 5 percent by weight of the feed mixture on a dry weight basis with amounts of from 1 to about 2 percent by weight being preferred. Recycled sintered material or returns may be present in the feed mix in greater amounts ranging from about 5 to 25 percent by weight of the feed on a dry weight basis with amounts of from 10 to about 20 percent by weight being preferred.

The gypsum desulfurization step involves heating the feed mixture under reducing conditions. The feed mixture is heated to a temperature sufficiently high to cause thermal degradation of the gypsum and to effect the reduction of the sulfur compounds to gaseous sulfur compounds in the +4 or lower oxidation state. The reaction temperature of the feed mixture generally ranges from about 1100° C. to about 1500° C., preferably from about 1200° C. to about 1300° C. In accordance with the present process, this temperature is initiated by burning the combustible gas resulting from the coal gasification and sulfur removal operations. Additional air is then introduced into the reactor in an amount sufficient to generate sufficient heat to support the endothermic gypsum-reduction reactions, yet still maintain reducing conditions. As used herein, the term "reducing conditions" means that the overall conditions in the reactor favor reduction of the gypsum compounds. Although both oxidation and reduction reactions take place in the reactor, the reducing conditions permit the formation of gaseous sulfur compounds.

Various types of reactors may be used to heat the gypsum containing feed mixture. Examples include rotary kilns, fluidized beds and travelling grates. A particularly preferred reactor is a circular travelling grate, such as that employed in the Gardner process described above.

When a circular travelling grate reactor is used, it is preferred that the feed mixture be formed into pellets. Such pellets may occur in a variety of shapes, such as balls, nodules, cylindrical pellets, etc. For proper pelletizing, at least a portion of the mixture is preferably relatively fine. The pelletizing can be accomplished in an open circuit balling pan or drum arrangement or a closed circuit balling pan or drum arrangement with sizing devices such as vibrating screens or roller separators. Preferably, the pelletizing operation produces balls or green pellets about 1 inch (25.4 mm) or less in diameter. One example of a suitable pelletizing pan apparatus is illustrated in U.S. Pat. No. 3,169,269. Water and/or other ingredients may be added to the mixture being pelletized to aid in forming green pellets.

In a preferred embodiment, the travelling grate mechanism includes sealed hoods and burners for heating the pellets under controlled reaction conditions to evolve sulfur and/or sulfur dioxide. One example of a preferred travelling grate mechanism is a liquid sealed circular grate (Carousel type) similar to the circular travelling grates commercially available from Davy McKee Corporation, Lakeland, Fla., 33807, U.S.A., having a size sufficient to handle large quantities of pellets economically. Travelling grates that may be used in the the present process are also disclosed in U.S. Pat. Nos. 3,302,936; 3,325,395; 4,111,755; 4,200,517; and 4,220,454 which are incorporated by reference in their entireties.

The present invention may be further understood and exemplified with reference to FIGS. 1–4.

FIG. 1 illustrates the principal features of the process of this invention. Coal is fed into a coal gasifier 10 where the coal is heated in the presence of an oxygen-lean atmosphere under partial coal-gasifying conditions to produce a solid carbonaceous char and a crude coal gas stream. The coal gas is directed to a sulfur removal zone 12 where the sulfur-containing compounds are separated from the coal gas to produce a combustible first gas stream. The sulfur-containing materials are converted to solid sulfur-containing materials and are fed to the gypsum desulfurization reactor 14 as part of the feed mixture. The solid carbonaceous char from the coal gasifier 10 is also fed into the gypsum reactor 14 along with gypsum and other optional materials, such as pyritic materials.

Figure 2:
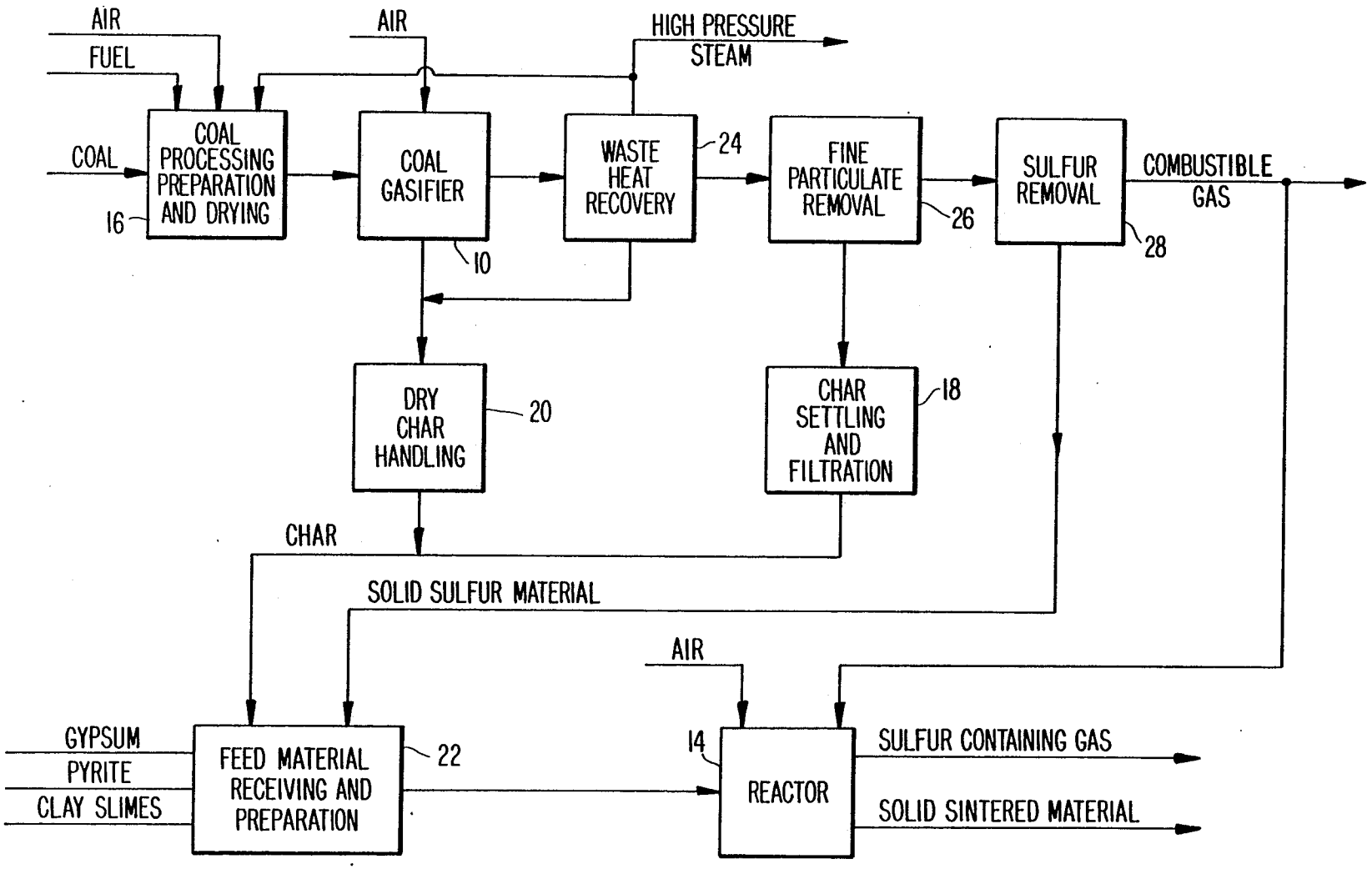
FIG. 2 is a schematic diagram of an embodiment of a process for the coproduction of a combustible gas and a sulfur-containing second gas stream.

FIG. 2 illustrates a preferred embodiment of the process in greater detail. Coal is fed into the coal processing and drying zone 16 where it is dried and comminuted. The processed coal is directed into the coal gasifier 10. The coal is heated in the gasifier 10 in the presence of an oxygen-lean atmosphere under partial coal-gasifying conditions to produce a solid carbonaceous char and a crude coal gas stream. The char is fed to a dry char handling zone 20 for later delivery to the gypsum feed material preparation area 22. The crude gas stream is directed to a waste heat recovery zone 24 where it is cooled and high pressure steam is produced. The crude gas stream, cooled to less than about 100° C., is fed into a fine particulate removal zone 26 where residual amounts of char are removed and discharged to char settling and filtration zone 18 for combination with the gypsum feed material. The crude gas stream is passed to the sulfur-removal zone 28 where the sulfur-containing compounds are separated from the crude gas stream to produce an environmentally acceptable combustible gas stream. The combustible gas stream can be used as an energy source including serving as a fuel for the gypsum desulfurization reactor 14. In the sulfur removal zone 28, the sulfur-containing compounds are converted into solid sulfur-containing materials. The solid sulfur-containing materials are fed to the gypsum feed material preparation zone 22. In the gypsum feed preparation zone 22 the gypsum, char and solid sulfur products are combined to form a feed mixture. Other materials may be added to the feed mixture including clays, phosphatic slimes and pyritic materials. The feed mixture is fed into the gypsum reactor 14 along with air and heated to reduce substantially all of the sulfur in the feed mixture to gaseous compounds of sulfur in a +4 or lower oxidation state. Upon heating under reducing conditions the gypsum desulfurization reactor 14 produces a solid sintered material and a sulfur-containing gas.

Figure 3:
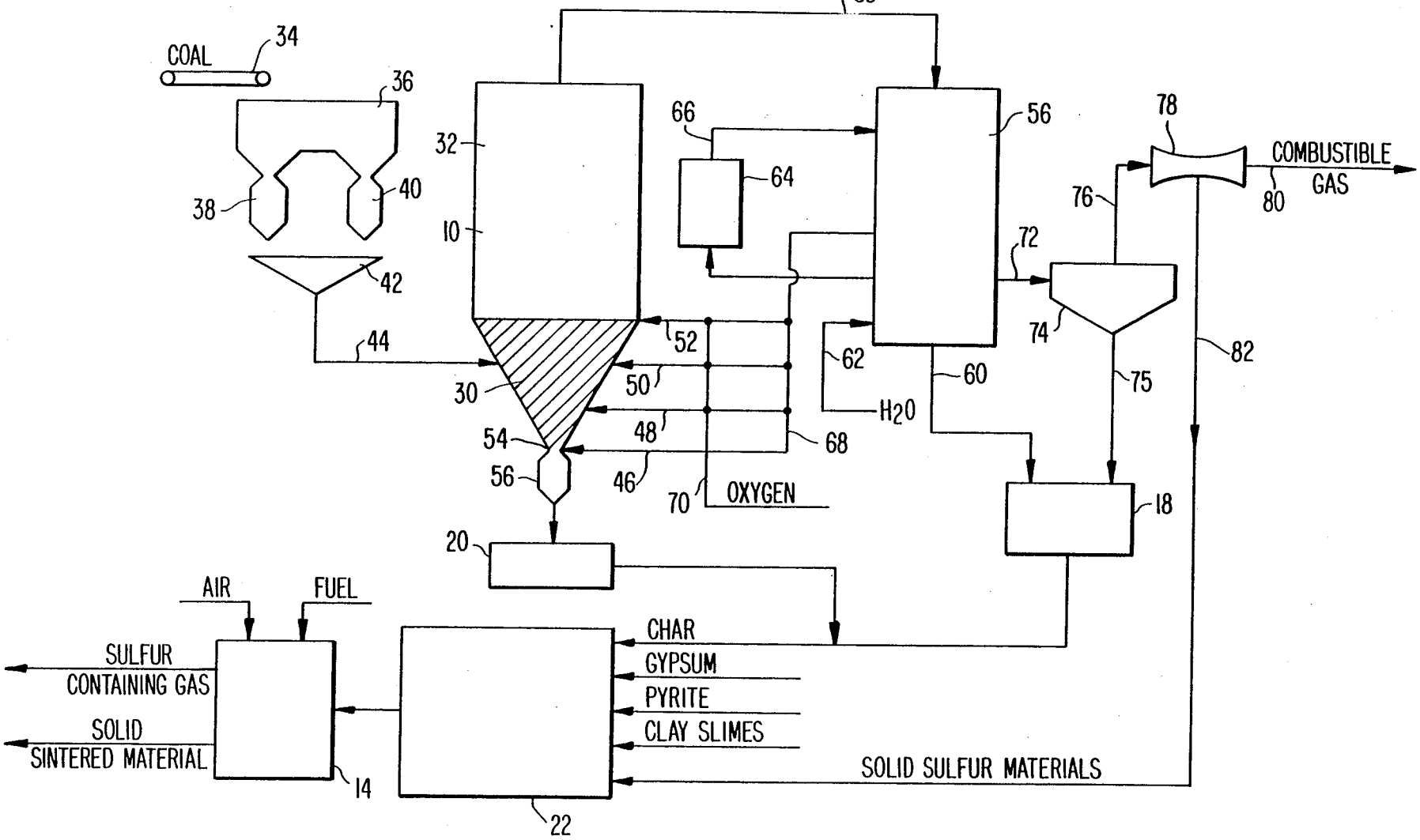
FIG. 3 is a schematic diagram of an embodiment of a process for the coproduction of a combustible gas and a sulfur-containing second gas stream employing a fluid bed coal gasifier.

In yet another embodiment illustrated in FIG. 3, gasifier 10 is depicted as a fluidized bed gasifier which contains a fluidized dense zone 30 and a dilute zone 32. The lower portion of gasifier 10 is a frustoconical segment, and the base of the bed resides therein. The reactants are combined in the bed.

The solid material fed to gasifier 10 may be processed in the following manner. Crushed coal is delivered to conveyor 34 and is transported to hopper 36. Conveyor 34 may be a belt conveyor, bucket conveyor, or the like. Conveniently, a chain conveyor may be employed since typically a chain conveyor does not jam nor does it stall when the receptacle is full.

Hopper 36 is shown as delivering crushed coal to two lock hoppers 38 and 40. In actual practice, particularly in operations involving pressures greater than, say, 2.5 atmospheres absolute, it may be desirable to provide additional lock hoppers, for insuring a continuous feed of coal to the gasifier. The lock hoppers operate to increase the pressure around the coal to a level suitable for inroduction into gasifier 10. Generally, the coal charge is at a pressure in excess of that in the gasifier to avoid a backflow of gases. Other means may be employed for bringing coal at ambient pressure to elevated pressure.

Lock hoppers 38 and 40 operate on a cycle. In the first stage of the cycle, a lower valve in the hopper is closed and the upper valve is opened to permit a charge of coal to enter the lock hopper. When the lock hopper is charged, an upper valve is closed and gas is introduced into it to provide an increased pressure. In the final stage, the charge at the increased pressure is released through the bottom of the hopper. The charge drops into holding hopper 42 as depicted. The introduction of pressurizing gas, e.g., an inert gas such as nitrogen or carbon dioxide, to the lock hopper may be continued during discharge to hasten delivery of the charge.

The coal is shown as being transported from holding hopper 42 to gasifier 10 through a screw conveyor which is schematically represented as line 44. The introduction of the coal may be at several points to promote better distribution, and, for a given product, enhance the operating characteristics of the process. Transport means may also be advantageously employed, and include rotary star feeders, and the like.

Often, the fluidizing gases are injected into gasifier 10 at a plurality of points. In this manner, the reaction in the dense phase bed may be controlled to increase utilization of the coal and provide a high quality product gas. As is illustrated, a stream containing essentially all (100 percent) steam is introduced through line 46 at the lower phase boundary of the fluidized bed. The steam not only serves as a primary fluidizing gas, but also, it cools char particles for discharge from the lower portion of gasifier 10. An oxygen-lean gas, which may also contain steam as diluent is introduced through lines 48, 50 and 52. The oxygen-lean gas and steam-diluent support the gasification reactions and assist along with any other diluents in the oxygen-containing gas and fluidizing the bed in controlling the temperature. Line 52 injects the oxygen-lean gas at or just above the phase boundary between the dense bed 30 and the dilute phase 32. The gas inlets are frequently semi-tangential nozzles. Generally, to insure good agitation, the fluidized bed may have a height to maximum diameter ratio of about 1:2 to 5:1. The dilute-phase, gas zone comprises entrained particles from the bed.

The bottom of gasifier 10 is provided with a means for removing char. The larger and heavier char particles are unstable and fall from the fluidized bed. These particles are collected and transported by water-cooled screw conveyor 54 to discharge lock hopper 56 for removal from gasifier 10. The particles are transported to the dry char handling zone 20 where a crusher may be provided to reduce the particle size of the char to a size which may be easily transported to the gypsum feed preparation zone 22.

The crude gas stream is directed to a heat exchanger 56 via line 58. The crude gas stream from gasifier 10 is cooled by indirect heat exchange in heat exchanger 56 where heat is recovered from it. Particulate material which is settled out of the gases during cooling may be removed from heat exchanger 56 via line 60. The particulate material may be disposed of in a manner like that for disposing of the char from the bottom of the gas generator or be directed to char settling and filtration zone 18 for processing prior to being mixed with the gypsum at the gypsum feed material preparation zone 22. The cooled gases exit heat exchanger 56 from line 72.

The heat exchange medium for heat exchanger 56 is shown as steam. Boiler feed water enters heat exchanger 56 via line 62 and, after being preheated, passes to steam drum 64 via line 66. Steam drum 64 may be in communication with a radiant boiler (not shown) in the upper portion of gasifier 10. The heat from the radiant boiler may be employed for indirect heat exchange to the steam in steam drum 64. Saturated steam, which was generated in heat exchanger 56, leaving steam drum 64 via line 66 returns to boiler 56 where it is super-heated prior to its return to the system via line 68. A portion of the steam from line 70 is combined with oxygen-lean gas provided by line 68 for introduction into gasifier 10 as diluent for the gas via lines 48, 50 and 52. Another portion of the steam passes through line 46 to the gasifier. The process may be operated under such conditions that sufficient steam is generated for its export from the gasification section. Under certain conditions, there will be sufficient sensible heat available which heat may be advantageously applied to the preheating of the oxygen-lean gas in the waste heat recovery train or, when desired, applied also to the gypsum desulfurization reactor 14.

The cooled gases exiting heat exchanger 56 are shown as passing, by line 72, through cyclone 74, which is provided with line 75 for removal of the separated particulate materials (i.e., char) to the char settling and filtration zone 18. The gas is passed via line 76 to scrubber 78. The bulk of the partially-spent char in the product gas is removed in the heat recovery unit and cyclone can be passed to the char settling and filtration zone 18 also known as a char hopper by means of a transfer screw conveyor. In combination, the heat recovery unit and cyclone can remove at least about 50, and preferably more than 75, percent (wt.) of the entrained solids in the product gas. From the char settling and filtration zone 18 the char is conveyed to the gypsum feed material preparation zone 22 for mixing.

Scrubber 78 removes particulate material and condenses steam from the gas. The gas from the cyclone flows through the venturi scrubber 78 where the remaining char is removed to a level of less than 1 grain/1000 SCF. To minimize water requirements, the venturi water is cooled and recirculated after removing the ash in a settler. Make-up water may be required for the ash settler. The char, in the form of a wet sludge, is removed from the settler and pumped to the settling and filtration zone 18.

This invention permits the use of high efficiency scrubbers. Suitable scrubbers include spray towers, cyclonic spray towers, venturi scrubbers (e.g., high efficiency, high pressure-drop type), and the like. The venturi or venturi-type scrubbers are particularly advantageous in that further downstream processing of the gases for particulate removal may not be required. Electrostatic precipitators have been employed downstream of the scrubber to remove entrained particles when required. The gases exit the scrubber via line 80.

Scrubber 78 also includes a means for removing sulfur compounds from the crude gas stream and converting the removed sulfur materials into solid sulfur containing materials. The solid sulfur materials are shown as passing via line 82 to the gypsum feed mixture preparation zone 22. In the feed mixture preparation zone 22 the materials are processed and combined in amounts such that the non-gypsum portion of the feed mixture contains sufficient reducing potential to reduce the sulfur in the gypsum to gaseous compounds of sulfur in a +4 or lower oxidation state. The feed mixture is fed into the gypsum reactor 14 wherein the feed mixture is heated under reducing conditions to produce a sulfur-containing gas stream and a solid sintered product.

Figure 4:
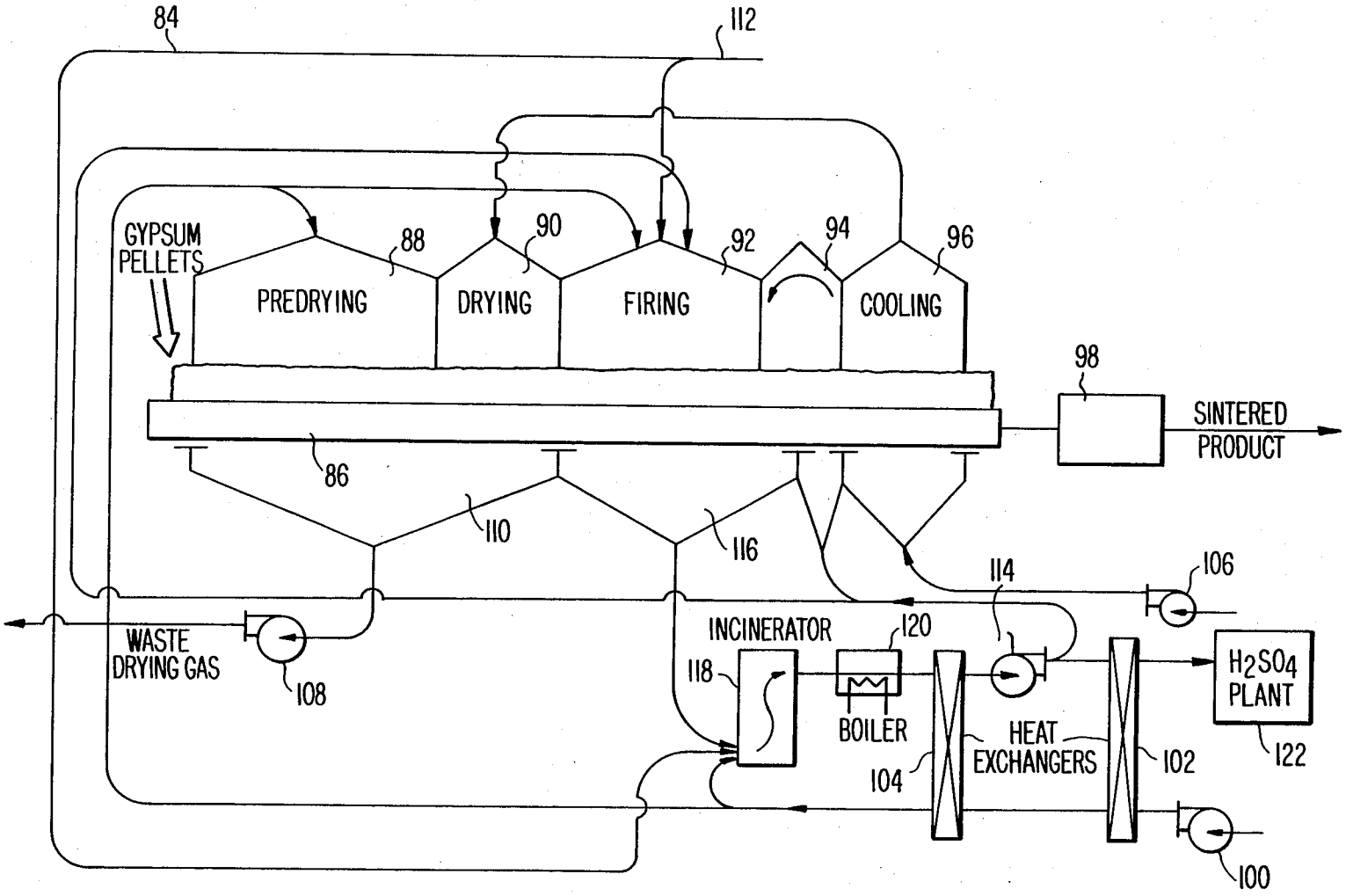
FIG. 4 is a schematic diagram of an embodiment of a travelling grate reactor suitable for use in the present invention.

An example of a suitable circular travelling grate mechanism 84 is illustrated in FIG. 4. The mechanism 84 includes facilities (not shown) for depositing a charge of green pellets upon a moving grate 86 which successively moves the charge through various zones, such as predrying zone 88, drying zone 90, firing zone 92, postfiring zone 94 and cooling zone 96, within a sealed hood to a facility 98 for discharging solids from the travelling grate. In the predrying zone 88 air from blower 100 which is heated in heat exchangers 102 and 104 by the product gas, is employed to remove at least a portion of the moisture from the green pellets. Blower 106 drives air through the hot charge on the grate 86 in the cooling zone 96 and thence to the drying zone 90 where the air completes the drying of the green pellets. The moist waste drying air is removed by blower 108 from a wind box 110 extending in the predrying and drying zones. Line 112 supplies combustible gas from the coal gasifier (after sulfur removal) (not shown) to the firing zone 92 sufficient to heat the surface of the charge to a temperature within the range of 1100° C. to 1550° C. Quantities of fresh air from the blower 100 and recycled product gas from blower 114 are also supplied to the firing zone 92. The product gas is removed from the firing zone 92 via wind box 116 and is then passed through an incinerator 118 where combustible gas products are burned with air from blower 100 and combustible gas from line 112. In post-firing zone 94, a portion of the product gas from blower 114 is recycled to pass upward through the charge and then downward into the product receiving wind box 116 to remove the greatest portion of product gas from the charge. The output product gas from the incinerator 118 is passed through a waste heat boiler 120 and the heat exchangers 104 and 102 where heat from the process is recovered. The effluent gas removed through heat exchanger 102 is passed to any conventional sulfuric acid plant 122. An example of a suitable plant is available from Davy McKee, Lakeland, Fla. 33807, U.S.A., which employs the Davy Double Absorption Catalytic process to convert sulfur dioxide to sulfuric acid.

The following examples represent computer simulations of the process of the present invention.

EXAMPLE 1

At a feed rate of 70,079 lbs per hour (additionally contains 3689 lbs per hour of moisture) Western Kentucky bituminous coal is scrubbed and dried. 300 lbs per hour of coal is lost to the scrub liquor. The scrub liquor is fed to a char settling and filtration zone. The remaining 69779 lbs per hour (plus 3673 lbs per hour of moisture) of the air dried coal is charged to a pressurized fluid bed gasifier. Air is introduced to the gasifier at a feed rate of 129,609 lbs per hour and steam at a feed rate of 16,234 lbs per hour at 150 psig. The temperature of the gasifier is controlled at about 1000° C. 24,396 lbs per hour of char are discharged from the gasifier and transferred to a dry char handling zone. The crude coal gas stream from the gasifier is passed to a waste heat recovery zone where the coal gas is cooled to a temperature of less than about 250° C., and fine char removed at a rate of 6280 lbs per hour. The coal gas is then directed to a fine particulate removal zone where a char slurry is removed at a rate of 698 lbs per hour. The fine char slurry is combined with the particulate from the scrub liquor and fed to the gypsum feed preparation zone at a feed rate of 31374 lbs per hour.

The cooled crude gas stream, at a temperature of below about 100° C. (e.g., from about 70° C. to about 99° C.), is passed to a sulfur-removal zone where the sulfur-containing compounds are removed and converted to a solid sulfur-containing material. The solid sulfur materials are removed from the desulfurization zone and introduced to the feed mixture preparation for the gypsum reactor at a feed rate of 1754 lbs per hour. The combustible clean gas stream is produced at a rate in excess of 17875 lbs per hour.

A feed mixture is continuously prepared for the gypsum reactor in a balling mechanism which forms the mixture into pellets suitable for charging into a travelling grate reactor. The components of the feed mixture are introduced to the balling mechanism at a feed rate of 31,374 lbs per hour for the char from the gasifier, 1757 lbs per hour for the recovered solid sulfur materials, 270,000 lbs per hour for the raw gypsum (plus 41,360 lbs per hour of moisture), 86,800 lbs per hour for pyrites (plus 865 lbs per hour of moisture) and 5,000 lbs per hour for phosphatic clay slimes (plus 21,150 lbs per hour of moisture).

The surface layer of the pelletized feed mixture is heated to a temperature of 800°-1000° C. on a rotary grate which is fueled by the product combustible gas from the coal gasifier at a feed rate of 17,875 lbs per hour. The reaction is maintained by feeding air to the reactor to maintain a temperature of 1200°-1500° C. The rotating grate produces 201,854 lbs per hour of a solid sintered material and 872,643 lbs per hour of wet sulfur dioxide-containing gas which can be used as a feedstock for the production of sulfuric acid. The sulfur dioxide containing gas on a dry basis is 7.24 mol % of carbon dioxide, 75.26 mol % nitrogen, 8.52 mol % oxygen and 8.97 mol % of sulfur dioxide.

EXAMPLE 2

This example illustrates the process of this invention using a Texas lignite.

At a feed rate of 92,500 lbs per hour, Texas lignite is scrubbed and dried. 300 lbs per hour of lignite is lost to the scrub liquor. The scrub liquor is fed to a char settling and filtration zone. The remaining 92,200 lbs per hour of dried Texas lignite is charged to a pressurized fluid bed coal gasifier. Air is introduced to the fluidized bed gasifier at a feed rate of 217,236 lbs per hour (moisture 5764 lbs per hour) and steam at a feed rate of 11,160 lbs per hour at 150 psig. The temperature of the gasifier is controlled at about 1000° C. Char is discharged from the gasifier at a rate of 3474 lbs per hour. The char is transferred to a dry char handling zone. The remaining gasifier products are passed to a waste heat recovery zone where the products are cooled and fine char removed at a rate of 30,342 lbs per hour. The fine char is transferred to the dry char handling zone. The crude gas stream is then directed to a fine particulate removal zone where a char slurry is removed from the crude gas stream at a rate of 3547 lbs per hour (75,200 lbs per hour of moisture). The coal scrubber liquor, fine char and char slurry are processed and directed to the feed mixture preparation zone for the gypsum reactor at a feed rate of 37,363 lbs per hour (plus 1650 lbs per hour moisture).

The cooled crude gas stream is passed to a sulfur removal zone where the sulfur-containing compounds are removed and converted to a solid sulfur-containing material. The recovered solid sulfur is removed from the desulfurization zone and transferred to the feed mixture preparation zone for the gypsum reactor at a feed rate of 1320 lbs per hour. The product combustible gas is produced at a rate in excess of 35,865 lbs per hour (plus 533 lbs per hour of moisture).

A feed mixture is continuously prepared for the gypsum ractor in a balling mechanism which forms the mixture into pellets suitable for charging into a travelling grate reactor. The various components are introduced to the balling mechanism at a feed rate of 37,363 lbs per hour of char (plus 1650 lbs per hour moisture), 1320 lbs per hour of recovered solid sulfur compounds, 268,000 lbs per hour of raw gypsum (plus 41,830 lbs per hour of moisture), 90,000 lbs per hour of pyrites (plys 900 lbs per hour of moisture) and 5000 lbs per hour of clay slimes (plus 21,150 lbs per hour of moisture).

The pelletized feed mixture is heated on a rotary grate fueled by a portion of product combustible gas at a feed rate of 26,560 lbs per hour (395 lbs per hour of moisture). The rotary grate produces 208,353 lbs per hour of solid sintered material and 877,590 lbs per hour of a wet sulfur dioxide-containing gas (50,984 lbs per hour of moisture) which can be used as a feedstock for the production of sulfuric acid. The sulfur dioxide-containing gas on a dry basis is 7.32 mol % of the carbon dioxide, 75.24 mol % of nitrogen, 8.47 mol % of oxygen and 8.94 mol % of sulfur dioxide.

EXAMPLE 3

Coal having the following chemical analysis was used in the following example.

| Component | Weight % |
|---|---|
| Ash | 12.95 |
| Carbon | 57.15 |
| Hydrogen | 4.27 |
| Nitrogen | 1.11 |
| Oxygen | 14.94 |
| Sulfur | 1.58 |
| Water | 8.00 |
| | 100.00 |

The above coal is continuously charged into a drying zone at a feed rate of 100,218 lbs per hour. The dried coal is fed into the bottom of a pressurized "Winkler"

reactor. 11,158 lbs per hour of steam at a pressure of 135 psig is introduced to the gasifier along with air (75.03 mol % of nitrogen, 20.04 mol % of oxygen, and 0.89 mol % of Argon) at a feed rate of 7919.06 lbs per hour. The coal is heated under partial gasifying conditions. Char is removed from the bottom of the gasifier at a feed rate of 3474 lbs per hour. The components of the char are 74.83 weight percent ash, 24.95 weight percent carbon and 0.22 weight percent sulfur. The char is directed to the feed preparation for the gypsum reactor. The other remaining gasifier products exit the top of the gasifier at a temperature of 1825° F. and a pressure of 83 psig. The products exiting the top of the reactor comprise the crude gas stream at a rate of 296,023.6 lbs per hour and solid particulates in the gas amounting to 33,713 lbs per hour. The crude gas stream has a chemical analysis of

| Component | Mole % |
|---|---|
| Carbon Monoxide | 15.58 |
| Carbon Dioxide | 7.29 |
| Hydrogen | 13.75 |
| Methane | 0.21 |
| Nitrogen | 50.55 |
| Argon | 0.58 |
| Hydrogen Sulfide | 8.34 |
| Carbonyl Sulfide | .84 |
| Water | 2.86 |
| | 100.00 |

The crude gas stream containing the particulates is cooled in a heat recovery zone which is operated at the exit temperature of 633° F. 142.2 MMBTU/hr of heat is transferred from the coal gas to the heat recovery zone as high pressure steam at a pressure of 900 psig. 4575 lbs per hour of ash and char are removed from the heat recovery zone. The recovered char from the heat recovery zone is directed to the feed preparation zone for the gypsum reactor. The crude gas stream, which still contains some particulates, is directed to a dry cyclone zone where char is removed from the crude gas stream at a rate of 25767 lbs per hour. The char from the dry cyclone is directed to the feed preparation zone for the gypsum reactor. The crude gas stream is directed through a desulfurization scrubber where the sulfur compounds are removed and converted into solid sulfur materials at a rate of 1319 lbs per hour. The solid sulfur materials are directed to the feed preparation zone for the gypsum reactor. The product combustible gas is produced at a rate of 275,897 lbs per hour and can be used as an energy source. The chemical analysis of the scrubbed combustible gas stream is

| Component | Mole % |
|---|---|
| Carbon Monoxide | 17.34 |
| Carbon Dioxide | 8.11 |
| Hydrogen | 15.30 |
| Methane | 0.24 |
| Nitrogen | 56.27 |
| Argon | .65 |
| Hydrogen Sulfide | .01 |
| Carbonyl Sulfide | .04 |
| Water | 2.04 |

While the present invention has been described with reference to particular embodiments thereof, it will be understood that numerous modifications may be made by those skilled in the art without actually departing from the spirit and scope of the invention as defined in the appended claims.

We claim:

1. A process for the coproduction of a combustible first gas stream usable as an energy source and a sulfur-containing second gas stream useable as a feedstock for the production of sulfuric acid, said process comprising the steps of:

(a) heating coal in the presence of an oxygen-lean atmosphere under partial coal-gasifying conditions to produce a solid carbonaceous char and a crude gas stream containing gaseous sulfur-containing compounds;

(b) separating the gaseous sulfur-containing compounds from the crude gas stream to produce a combustible first gas stream and converting the separated sulfur-containing compounds to a solid sulfur-containing material;

(c) forming a feed mixture by combining the solid carbonaceous char from step (a) and the solid sulfur-containing material from step (b) with gypsum in proportions such that the non-gypsum portion of the feed mixture contains sufficient reducing potential to reduce sulfur in the gypsum to gaseous compounds of sulfur in +4 or lower oxidation state;

(d) heating the feed mixture from step (c) under reducing conditions to produce a sulfur-containing second gas stream.

2. The process of claim 1, wherein step (a) comprises heating particulate coal in the presence of an oxygen-lean atmosphere which contains up to about 50% by volume of steam, wherein the oxygen content and the feed rate of the oxygen-lean atmosphere are controlled to maintain a temperature of from about 700° C. to about 1100° C.

3. The process of claim 2, wherein the feed rate of the oxygen-lean atmosphere is controlled to maintain a temperature of from about 700° C. to about 1000° C.

4. The process of claim 3, wherein the partial coal-gasifying conditions include a pressure of from about 1.5 to about 20 atmospheres.

5. The process of claim 1, wherein the partial coal-gasifying conditions of step (a) are controlled to produce a solid carbonaceous char which contains from about 40 to about 80% by weight carbon.

6. The process of claim 1, wherein the feed mixture resulting from step (c) is pelletized prior to being subjected to step (d).

7. The process of claim 1, wherein step (c) further comprises combining pyritic material with the solid carbonaceous char, the solid sulfur-containing material and the gypsum.

8. The process of claim 7, wherein the pyritic material is pyrite, metallic iron, elemental sulfur, iron oxide or iron (II) sulfide.

9. The process of claim 8, wherein the pyritic material is pyrite and is added to the feed mixture at a concentration of from about 0 to about 20% by weight.

10. The process of 1, 4 or 7, wherein the feed mixture formed in step (c) contains from about 50 to about 80% by weight gypsum; a sufficient amount of the carbonaceous char to provide a carbon concentration in the feed mixture of from about 3 to about 11% by weight; and from about 0 to about 20% by weight pyritic material.

11. The process of claim 10, wherein the feed mixture of step (c) is formed into pellets having an average diameter of from about 1 inch or less.

12. The process of claim 1, wherein prior to the heating step (d), the feed mixture is dried.

13. The process of claim 12, wherein the feed mixture is dried by burning a portion of the combustible first gas stream to produce a hot spent combustion gas and passing the hot spent combustion gases through the feed mixture.

14. The process of claim 13, wherein at least a portion of the combustible first gas stream is used as a fuel for producing steam and the steam is directed to the oxygen-lean atmosphere of step (a).

15. The process of claim 12, wherein the heating of the feed mixture in step (d) is achieved by passing a mixture of air and a combustible gas, selected from the group consisting of the crude gas stream from step (a), the combustible first gas stream from step (b) and mixtures thereof, through said feed mixture, wherein the flow ratios of the air and the combustible gas are controlled to maintain a temperature sufficiently high to cause thermal decomposition and reduction of the gypsum, and to maintain reducing conditions within the feed mixture.

16. The process of claim 15, wherein the combustible gas used for heating the feed mixture is the combustible first gas stream from step (b) and the flow rates of the air and the combustible first gas stream are controlled to maintain a temperature of the feed mixture of from about 1100° C. to about 1500° C.

17. The process of claim 16, wherein the flow rates of the air and the combustible first gas stream are controlled to maintain a temperature of from about 1200° C. to about 1400° C.

18. The process of claim 1, wherein step (d) is conducted in a rotary kiln, a fluid bed reactor or a travelling grate reactor.

19. The process of claim 18, wherein the heating of step (d) is conducted in a rotary kiln for a period of from about 2 to about 4 hours.

20. The process of claim 18, wherein the heating of step (d) is conducted in a fluid bed reactor for a period of from about 0.25 to about 2 hours.

21. The process of claim 1, wherein the heating of step (d) is conducted in a travelling grate reactor.

22. The process of claim 21, wherein step (d) includes moving the travelling grate carrying a charge of pelletized feed mixture successively through firing and post-firing zones, and the charge is retained in the post-firing zone for a period of from about 10 to about 30 minutes.

23. The process of claim 22, wherein a portion of said sulfur-containing second gas stream is passed through the charge in the post-firing zone.

24. The process of claim 1, wherein the sulfur-containing second gas stream is passed to a sulfuric acid plant.

25. The process of claim 1, wherein the coal is lignite, subbituminous, or bituminous.

26. The process of claim 10, wherein the feed mixture comprises on a dry weight basis, (a) from about 55 to about 75 percent by weight of gypsum;
(b) from about 4 to about 9 percent by weight of char as carbon;
(c) from about 5 to about 15 percent by weight of pyritic material.
(d) from about 0 to about 5 percent by weight of clay, lime or mixtures thereof.

* * * * *